US009597893B2

(12) United States Patent
Kudo et al.

(10) Patent No.: US 9,597,893 B2
(45) Date of Patent: Mar. 21, 2017

(54) ELEMENT SUBSTRATE AND LIQUID DISCHARGE HEAD

(71) Applicant: CANON KABUSHIKI KAISHA, Tokyo (JP)

(72) Inventors: Tomoko Kudo, Kawasaki (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/966,615

(22) Filed: Dec. 11, 2015

(65) Prior Publication Data

US 2016/0193837 A1 Jul. 7, 2016

(30) Foreign Application Priority Data

Jan. 6, 2015 (JP) ..... 2015-001073

(51) Int. Cl.
*B41J 2/14* (2006.01)
*B41J 2/335* (2006.01)

(52) U.S. Cl.
CPC ..... *B41J 2/335* (2013.01); *B41J 2/14072* (2013.01); *B41J 2202/13* (2013.01); *B41J 2202/21* (2013.01)

(58) Field of Classification Search
CPC ..... B41J 2/14088; B41J 2/335; B41J 2/155; B41J 2/05
See application file for complete search history.

(56) References Cited

U.S. PATENT DOCUMENTS 5,144,341 A 9/1992 El Haten et al.
6,388,691 B1 5/2002 Maeyama et al.
6,409,315 B2 6/2002 Komuro
6,501,108 B1 * 12/2002 Suzuki ..... H01L 27/092 257/210
7,806,495 B2 10/2010 Kasai
8,147,039 B2 4/2012 Kurokawa et al.
(Continued)

FOREIGN PATENT DOCUMENTS

JP 7-314658 A 12/1995
JP 10-44416 A 2/1998
(Continued)

OTHER PUBLICATIONS

U.S. Appl. No. 14/982,599, filed Dec. 29, 2015.

*Primary Examiner* — Manish S Shah
*Assistant Examiner* — Yaovi M Ameh
(74) *Attorney, Agent, or Firm* — Fitzpatrick, Cella, Harper & Scinto

(57) ABSTRACT

If the shape of an element substrate is a parallelogram, a trapezoid, an uneven shape, or the like, there is no region where a driver transistor corresponding to a heater in the vicinity of an end portion of the element substrate is arranged, and thus the heater cannot be arranged near the end portion. The layout arrangement of driving circuits suitable for the substrate shape is required while suppressing an increase in the area of the element substrate. In an embodiment of this invention, the diffusion layer of the drain electrode of a driver transistor for driving a heater is divided in a direction perpendicular to that in which heaters are arranged, and the divided portions are connected to form one driver transistor. The divided portions are arranged stepwise.

11 Claims, 11 Drawing Sheets

(56) References Cited

U.S. PATENT DOCUMENTS

| | | | | |
|---|---|---|---|---|
| 9,102,146 | B2 | 8/2015 | Yamato et al. | |
| 2001/0052916 | A1 | 12/2001 | Komuro | |
| 2002/0125511 | A1 | 9/2002 | Shimotsusa | |
| 2005/0052499 | A1 | 3/2005 | Oomura | |
| 2005/0140736 | A1 | 6/2005 | Imanaka et al. | |
| 2005/0179738 | A1 | 8/2005 | Mihara et al. | |
| 2005/0206685 | A1* | 9/2005 | Hirayama | B41J 2/04541 347/57 |
| 2005/0212857 | A1* | 9/2005 | Hirayama | B41J 2/04541 347/57 |
| 2005/0264608 | A1 | 12/2005 | Hirayama | |
| 2006/0284909 | A1 | 12/2006 | Kasai et al. | |
| 2007/0046738 | A1* | 3/2007 | Yagi | B41J 2/14024 347/71 |
| 2009/0174753 | A1* | 7/2009 | Kurokawa | B41J 2/04523 347/56 |

FOREIGN PATENT DOCUMENTS

| | | | | |
|---|---|---|---|---|
| JP | 2004-243542 | A * | 9/2004 | B41J 2/05 |
| JP | 2009-160883 | A | 7/2009 | |
| JP | 2010-505642 | A | 2/2010 | |
| WO | 2008/043120 | A1 | 4/2008 | |

* cited by examiner

ELEMENT SUBSTRATE AND LIQUID DISCHARGE HEAD

BACKGROUND OF THE INVENTION

Field of the Invention

The present invention relates to an element substrate and a liquid discharge head, and particularly to, for example, a full-line printhead to which a liquid discharge head incorporating an element substrate is applied to perform printing according to an inkjet method, and a printing apparatus for performing printing using the full-line printhead. More specifically, the present invention relates to a printhead mounting an element substrate on which a plurality of print elements and driving circuits for driving the respective print elements are provided, and a printing apparatus.

Description of the Related Art

As described in, for example, Japanese Patent Laid-Open No. 2009-160883, the electrothermal transducers (heaters) of a printhead mounted in a printing apparatus complying with the inkjet method and driving circuits of the heaters are formed on the same substrate using a semiconductor manufacturing process technique. As one configuration using the element substrate, there is proposed a printhead having a configuration in which an ink supply port is formed near the center of the element substrate, and a heater and an ink orifice corresponding to it oppose each other to sandwich the ink supply port.

As disclosed in Japanese Patent Laid-Open No. 2009-160883, in general, the heater and driver transistor are arranged adjacent to each other on the element substrate, a heater pitch and a driver transistor pitch are equal to each other, and one driver transistor is connected to one heater.

Japanese PCT National Publication No. 2010-505642 discloses an arrangement in a case where a plurality of chips are mounted on a printhead. In an element substrate having a shape of a parallelogram, since it is possible to arrange chips adjacent to each other by shifting them in a heater array direction, a head width can be shortened, as compared with a configuration in which a plurality of chips are arranged in a staggered pattern on a rectangular element substrate. Since, therefore, the heater distance with respect to a neighboring element substrate becomes short and ink orifices become closer to each other, it can be expected to improve the image quality in the connection portion of the element substrates. For this reason, various shapes other than a rectangle are proposed as the shape of the element substrate.

Along with a recent increase in print speed and recent improvement in image quality, the number of print elements integrated in a printhead is increasing. This imposes problems such as an increase in the area of an element substrate integrating circuits for driving the print elements, and optimization of the arrangement of heaters to mount a plurality of element substrates in a printhead in a case where the shape of each element substrate is a parallelogram, a trapezoid, or the like.

An increase in the area of an element substrate results in an increase in the size of a printhead, thereby influencing the size of a printing apparatus main body. This is a big problem conflicting with downsizing of the printing apparatus. Therefore, it is required to reduce the area of the element substrate.

If an element substrate has a shape such as a parallelogram, trapezoid, or uneven shape, the substrate end is inclined or has a concave shape. As for a conventional element and circuit layout, therefore, there is no region where a driver transistor corresponding to a heater in the vicinity of an end portion of the element substrate is arranged. Consequently, it is impossible to arrange a heater in the vicinity of the end portion of the element substrate. To implement a predetermined number of heaters, the substrate area increases, as compared with a rectangular element substrate, and the arrangement of driving circuits suitable for the substrate shape is thus required.

SUMMARY OF THE INVENTION

Accordingly, the present invention is conceived as a response to the above-described disadvantages of the conventional art.

For example, an element substrate according to this invention is capable of employing an optimum layout arrangement in consideration of various shapes.

According to one aspect of the present invention, there is provided an element substrate comprising: a plurality of electrothermal transducers arranged in a predetermined direction; and a plurality of driver transistors respectively corresponding to the plurality of electrothermal transducers and configured to drive the plurality of electrothermal transducers, wherein each of the plurality of driver transistors is divided into a plurality of portions in a direction intersecting the predetermined direction, and the plurality of divided portions are connected to form one driver transistor, and connected to the corresponding electrothermal transducer.

According to another aspect of the present invention, there is provided an element substrate having a surface in which a plurality of electrothermal transducers arranged in a first direction and configured to generate energy to be used to discharge liquid are provided, comprising: a first electrothermal transducer included in the plurality of electrothermal transducers; and a plurality of driver transistors configured to drive the first electrothermal transducer, wherein when viewed from a direction perpendicular to the surface, the plurality of driver transistors are arranged in a second direction intersecting the first direction.

According to still another aspect of the present invention, there is provided a liquid discharge head used as a full-line printhead formed by arranging a plurality of element substrates having the above arrangement in the arrangement direction of the plurality of electrothermal transducers so as to have a printing width corresponding to the width of a print medium.

The invention is particularly advantageous since a multistage arrangement in which each driver transistor is divided is employed, and it is thus possible to arrange the driver transistors in accordance with the shape of an element substrate and a circuit layout. This can suppress an increase in substrate area.

Further features of the present invention will become apparent from the following description of exemplary embodiments (with reference to the attached drawings).

DESCRIPTION OF THE EMBODIMENTS

Figure 1:
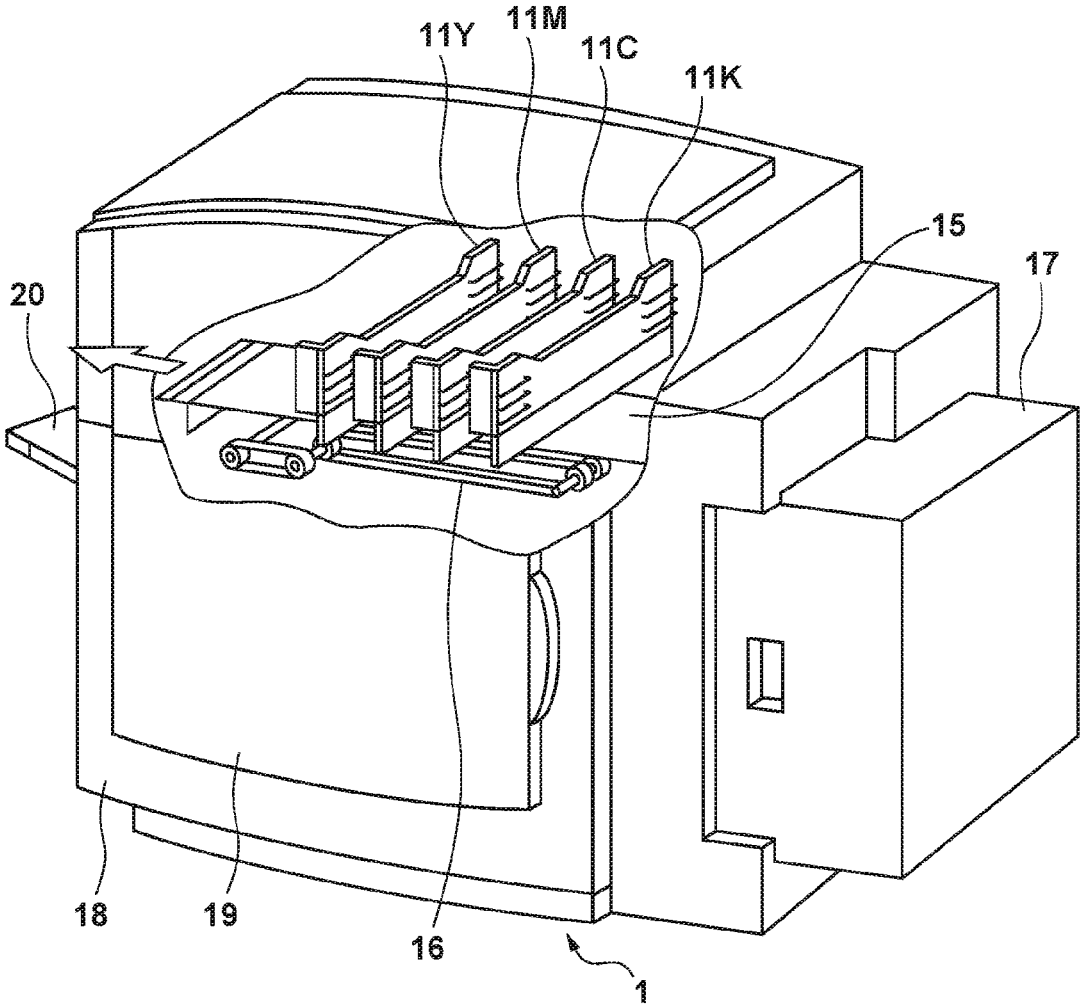
FIG. 1 is a perspective view for explaining the structure of a printing apparatus including a full-line printhead as an exemplary embodiment of the present invention.

Exemplary embodiments of the present invention will now be described in detail in accordance with the accompanying drawings. Note that the same reference numerals denote already explained parts, and a repetitive description thereof will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, that are capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" generically means an ink orifice or a liquid channel communicating with it, and an element for generating energy used to discharge ink, unless otherwise specified.

An element substrate (head substrate) for a printhead to be used below indicates not a mere base made of silicon semiconductor but a component provided with elements, wirings, and the like.

"On the substrate" not only simply indicates above the element substrate but also indicates the surface of the element substrate and the inner side of the element substrate near the surface. In the present invention, "built-in" is a term not indicating simply arranging separate elements on the substrate surface as separate members but indicating integrally forming and manufacturing the respective elements on the element substrate in, for example, a semiconductor circuit manufacturing process.

<Printing Apparatus with Full-Line Printhead (FIG. 1)>

FIG. 1 is a perspective view for explaining the structure of a printing apparatus 1 including full-line inkjet printheads (to be referred to as printheads hereinafter) 11K, 11C, 11M, and 11Y, and a recovery unit for always guaranteeing stable ink discharge.

In the printing apparatus 1, a printing sheet 15 is supplied from a feeder unit 17 to the printing positions of the printheads, and conveyed by a conveyance unit 16 arranged in a housing 18 of the printing apparatus.

In printing an image on the printing sheet 15, while conveying the printing sheet 15, the printhead 11K discharges black (K) ink when the reference position of the printing sheet 15 reaches a position below the printhead 11K for discharging black ink. Similarly, when the printing sheet 15 sequentially reaches the reference position of the printhead 11C for discharging cyan (C) ink, that of the printhead 11M for discharging magenta (M) ink, and that of the printhead 11Y for discharging yellow (Y) ink, the printheads 11C, 11M, and 11Y discharge the respective color inks, thereby forming a color image. The printing sheet 15 on which the image has been printed is discharged to a stacker tray 20 and stacked.

The printing apparatus 1 further includes the conveyance unit 16, and ink cartridges (not shown) exchangeable for the respective inks to supply inks to the printheads 11K, 11C, 11M, and 11Y. The printing apparatus 1 also includes pump units (not shown) for ink supply and recovery operations for the printheads 11K, 11C, 11M, and 11Y, and a control substrate (not shown) for controlling the overall printing apparatus 1. A front door 19 is an opening/closing door for exchanging the ink cartridge.

<Printing Apparatus Using Large-Size Print Medium (FIGS. 2A and 2B)>

Figure 2A:
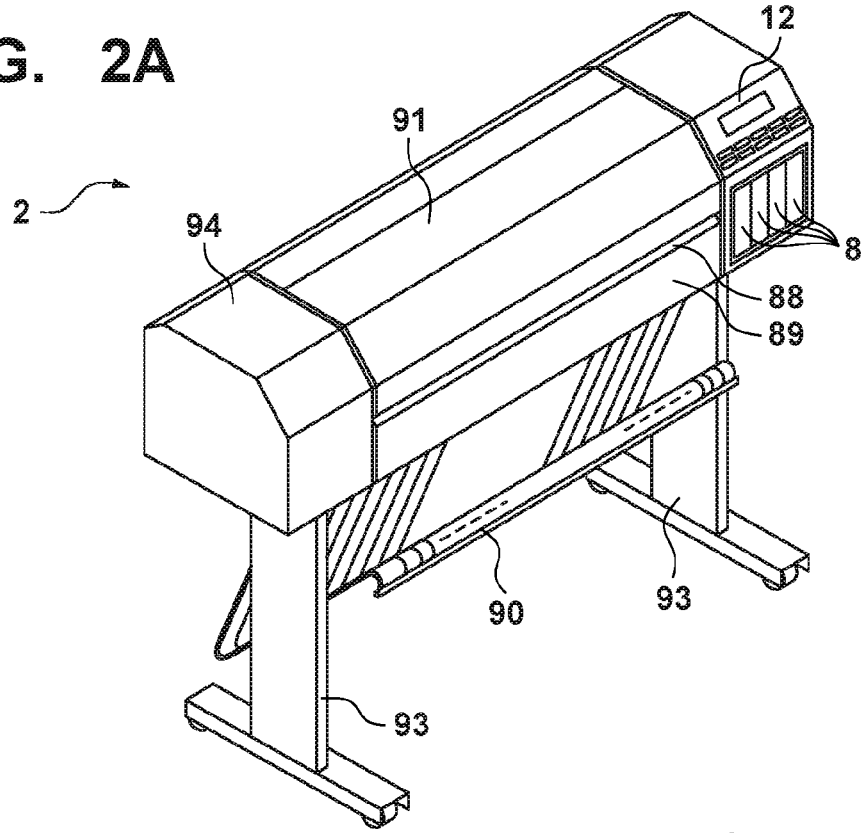
FIGS. 2A and 2B are perspective views each showing the outer appearance of the printing apparatus using A0- and B0-size print media.
Figure 2B:
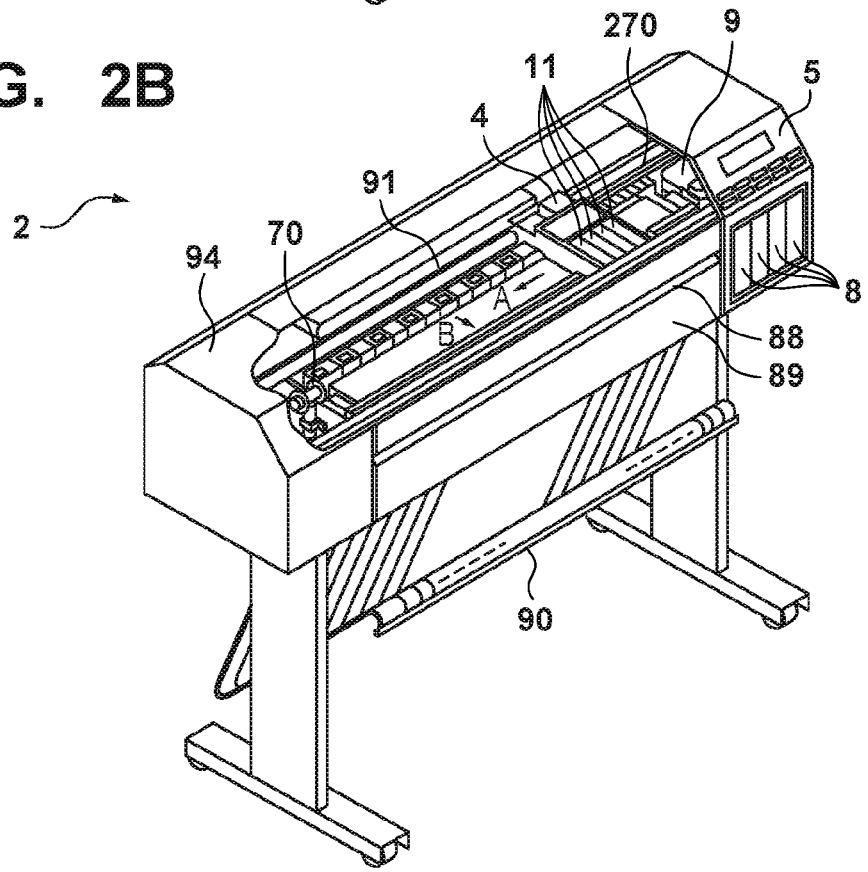

FIGS. 2A and 2B are perspective views each showing the outer appearance of a printing apparatus using A0- and B0-size print media. FIG. 2B is a perspective view showing a state in which the upper cover of the printing apparatus shown in FIG. 2A is removed.

As shown in FIG. 2A, a printing apparatus 2 has a manual insertion port 88 on the front surface, and a roll paper cassette 89 which can open to the front side is arranged below the manual insertion port 88. A print medium such as printing paper is supplied from the manual insertion port 88 or roll paper cassette 89 into the printing apparatus. The printing apparatus 2 includes an apparatus main body 94 supported by two legs 93, a stacker 90 in which a discharged print medium is stacked, and an openable/closable see-through upper cover 91. An operation panel 12, ink supply units, and ink tanks are disposed on the right side of the apparatus main body 94.

As shown in FIG. 2B, the printing apparatus 2 further includes a conveyance roller 70 for conveying a print medium in a direction (sub-scanning direction) indicated by an arrow B, and a carriage 4 which is guided and supported to be able to reciprocate in the widthwise direction (indicated by an arrow A: main scanning direction) of the print medium. The printing apparatus 2 also includes a carriage motor (not shown) for reciprocating the carriage 4 in the direction indicated by the arrow A, a carriage belt (to be referred to as a belt hereinafter) 270, and printheads 11 mounted on the carriage 4. The printing apparatus 2 includes a suction ink recovery unit 9 which supplies ink and cancels an ink discharge failure caused by clogging of the orifice of the printhead 11 or the like.

In this printing apparatus, the printheads 11 formed from four heads in correspondence with four color inks are mounted on the carriage 4 to print in color on a print medium. That is, the printheads 11 are formed from, for example, a K (black) head for discharging K ink, a C (Cyan)

head for discharging C ink, an M (Magenta) head for discharging M ink, and a Y (Yellow) head for discharging Y ink.

When printing on a print medium by the above arrangement, the conveyance roller 70 conveys the print medium to a predetermined printing start position. Then, the carriage 4 repeats an operation of causing the printhead 11 to scan in the main scanning direction and an operation of causing the conveyance roller 70 to convey the print medium in the sub-scanning direction, thereby printing on the entire print medium.

More specifically, the belt 270 and a carriage motor (not shown) move the carriage 4 in the direction indicated by the arrow A shown in FIG. 2B, thereby printing on a print medium. When the carriage 4 returns to a position (home position) before scanning, the conveyance roller conveys the print medium in the sub-scanning direction (the direction indicated by the arrow B shown in FIG. 2B), and the carriage then scans again in the direction indicated by the arrow A in FIG. 2B. In this way, an image, character, or the like is printed on the print medium. After this operation is repeated to end printing of one print medium, the print medium is discharged to the stacker 90, thereby completing printing of one print medium.

<Description of Control Arrangement (FIG. 3)>

Next, a control arrangement for executing printing control of the printing apparatus described with reference to FIG. 1 or FIGS. 2A and 2B will be explained.

Figure 3:
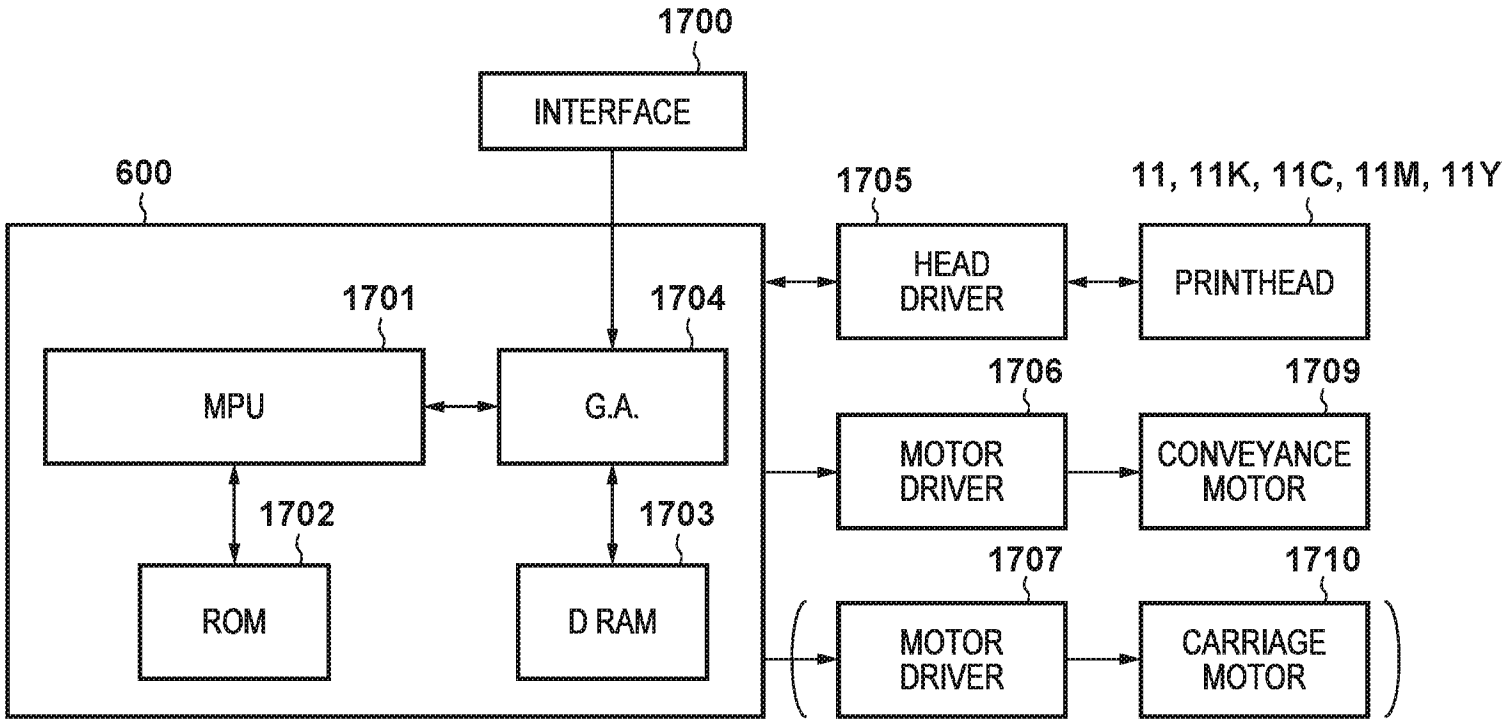
FIG. 3 is a block diagram showing the control arrangement of the printing apparatus shown in FIG. 1 or FIGS. 2A and 2B.

FIG. 3 is a block diagram showing the arrangement of the control circuit of the printing apparatus. In FIG. 3, reference numeral 1700 denotes an interface for inputting print data; 1701, an MPU; 1702, a ROM storing a control program to be executed by the MPU 1701; 1703, a DRAM for saving data such as print data, and a print signal to be supplied to the printhead; and 1704, a gate array (G.A.) for controlling supply of a print signal to the printhead, and also controlling data transfer between the interface 1700, the MPU 1701, and the DRAM 1703. A controller 600 includes the MPU 1701, ROM 1702, DRAM 1703, and gate array 1704. Reference numeral 1710 denotes a carriage motor for conveying the printhead(s) 11, or 11K, 11C, 11M, and 11Y; 1709, a conveyance motor for conveying a printing sheet; 1705, a head driver for driving the printhead; and 1706 and 1707, motor drivers for driving the conveyance motor 1709 and the carriage motor 1710, respectively.

Note that for the printing apparatus having the arrangement using the full-line printhead as shown in FIG. 1, the carriage motor 1710 and the motor driver 1707 for driving the motor are not arranged, so their reference numerals are parenthesized in FIG. 3.

The operation of the above control arrangement will be explained. When print data is input to the interface 1700, it is converted into a print signal for printing between the gate array 1704 and the MPU 1701. Then, the motor drivers 1706 and 1707 are driven. At the same time, the printhead is driven in accordance with the print data sent to the head driver 1705, thereby performing printing. Information of a transfer error (to be described later) obtained by the printhead is fed back to the MPU 1701 via the head driver 1705 and reflected in printing control.

Some embodiments of the element substrate of the printhead mounted in the printing apparatus having the above arrangement will now be described.

First Embodiment

Figure 4A:
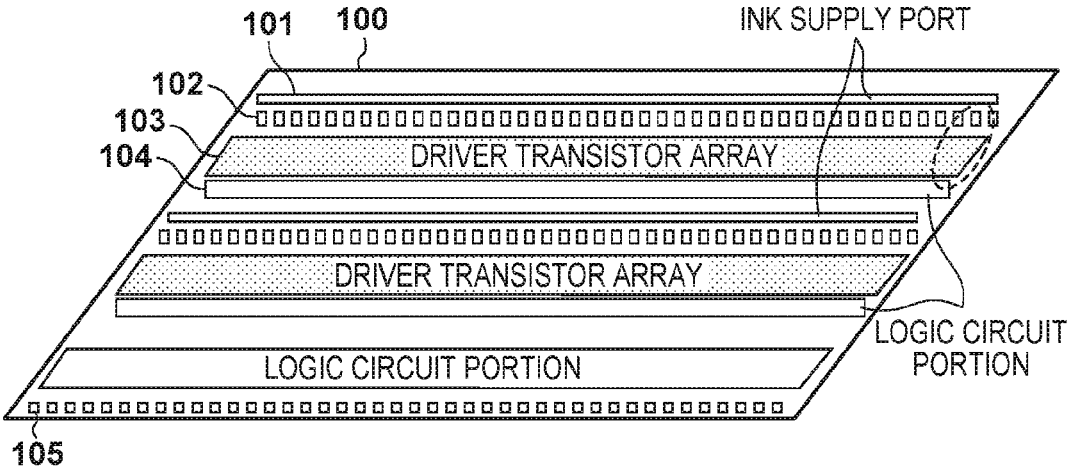
FIGS. 4A, 4B, and 4C are views for explaining an element substrate according to the first embodiment.
Figure 4B:
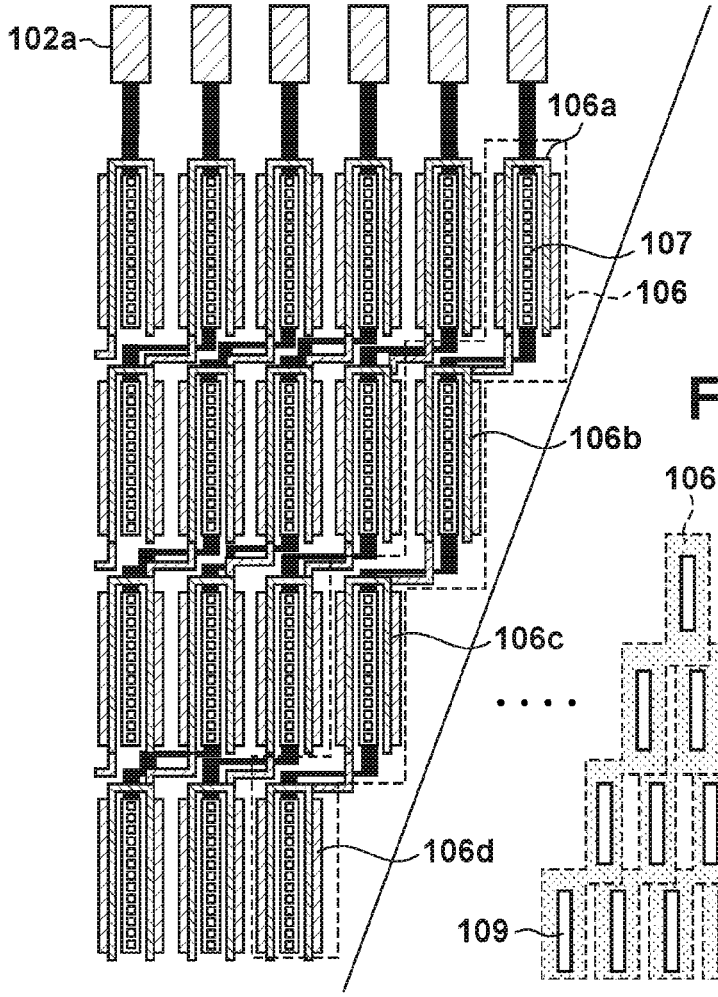
Figure 4C:
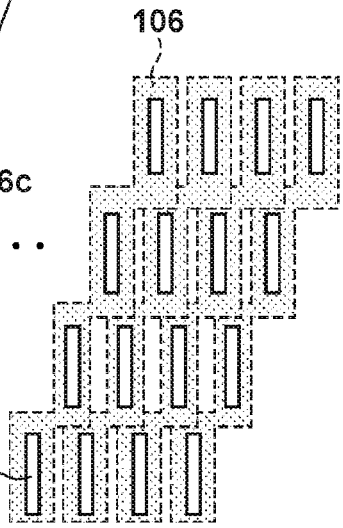

FIGS. 4A to 4C are views for explaining an element substrate according to the first embodiment.

In FIG. 4A, reference numeral 100 denotes an element substrate obtained by integrally forming heaters (electrothermal transducers) and driving circuits by a semiconductor manufacturing process technique; reference numeral 101, ink supply ports for supplying ink from the lower surface of the element substrate; reference numeral 102, heater arrays each formed by arranging a plurality of heaters; reference numeral 103, driver transistor arrays each formed by arranging a plurality of driver transistors for supplying any desired electric current to the heaters to discharge ink; reference numeral 104, logic circuit portions each for generating, from a shift register and a decoder, a signal for selecting each segment of the heater array and driver transistor array; and reference numeral 105, connection terminals (electrodes) each for inputting or outputting an electric signal from or to the outside of the element substrate.

Note that an arrangement example in which the ink supply port 101 is common to one array is shown. However, an ink supply port can be individually arranged in correspondence with each heater or ink supply ports can be arranged on two sides of each heater.

FIG. 4B is an enlarged view showing a portion of the heater array and driver transistor array in an end portion of the element substrate 100, indicated by a broken line circle in FIG. 4A. FIG. 4B shows individual heaters 102*a*, and individual driver transistors 106, one of which is surrounded by broken lines.

As shown in FIG. 4B, one driver transistor 106 connected to one heater 102*a* is divided into four portions 106*a* to 106*d* which are formed stepwise and connected in accordance with the inclined shape of the end portion. In each of the portions 106*a* to 106*d*, contact holes 107 each for connecting the conductive layer of a drain electrode to a lower diffusion layer are formed. FIG. 4C schematically shows the shape of each driver transistor 106 connected to each heater 102*a* and diffusion layers 109 of drain electrodes.

Figure 5:
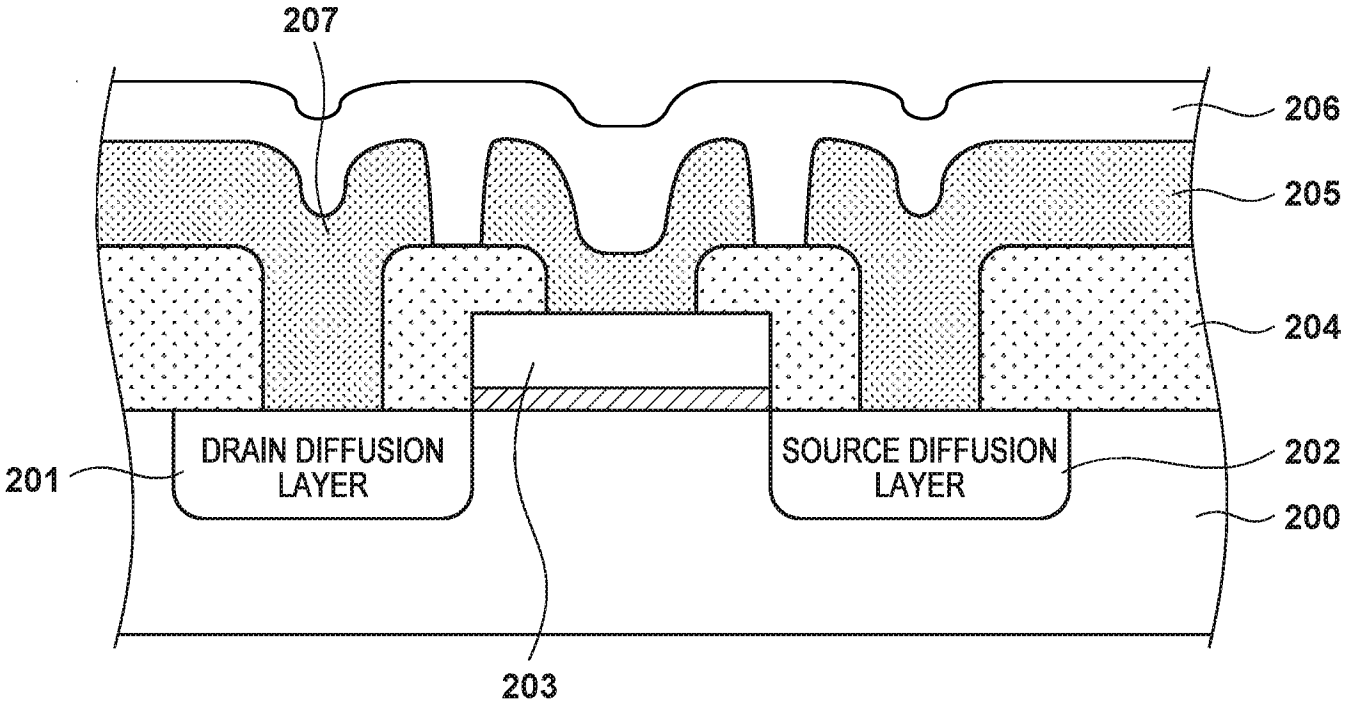
FIG. 5 is a sectional view of a MOSFET.

FIG. 5 is a sectional view of a general MOSFET.

In FIG. 5, reference numeral 200 denotes a silicon substrate; reference numeral 201, a diffusion layer in which an impurity is implanted to serve as a drain electrode; reference numeral 202, a diffusion layer serving as a source electrode; reference numeral 203, a gate electrode; reference numeral 204, an insulation film; reference numeral 205, a conductive film; reference numeral 206, a protection film; and reference numeral 207, a contact hole for connecting the conductive film 205 to the diffusion layer 201.

A voltage applied to the gate electrode 203 forms a channel between the drain electrode 201 and the source electrode 202 to supply an electric current. Since a high voltage is applied to the driver transistor 106 for driving the heater 102*a*, a high-voltage resistant transistor may be used and the structure of the diffusion layer may be different. However, the basic structure and operation are the same.

The driver transistor 106 shown in FIGS. 4B and 4C has an arrangement in which two gate electrodes are arranged and a source electrode is arranged outside. In a case where the source electrode can be shared with the neighboring driver transistor 106, the layout efficiency is high. Note that FIGS. 4B and 4C do not show the connection wirings and contact holes of the source electrodes for the sake of simplicity.

In the first embodiment, the driver transistor 106 connected to one heater 102*a* is divided into portions which are formed stepwise and connected, as shown in FIGS. 4B and 4C. Note that dividing the driver transistor 106 is equivalent to dividing the diffusion layer of the drain electrode. It is impossible to confirm from the upper surface of the element substrate 100 that the diffusion layer is divided, but each contact hole 107 is used to connect the diffusion layer and conductive film, and thus a region in which the contact holes 107 are arranged is a region of the diffusion layer 109. Note that this embodiment may be understood as a configuration in which each of divided driver transistors 106*a*, 106*b*, 106*c* and 106*d* are treated as a single transistor, a plurality of the driver transistors 106*a*, 106*b*, 106*c* and 106*d* have respective diffusion layers of divided drain electrodes, and one heater 102*a* is driven by the driver transistors 106*a*, 106*b*, 106*c* and 106*d*.

Unlike a conventional example, this embodiment has as its feature dividing and arranging the diffusion layer of the drain electrode in a direction perpendicular to the direction of the heater array 102 instead of arranging the diffusion layers of the drain electrodes in line or arranging the diffusion layers as a group in a heater array direction. Note that a plurality of gate electrodes (a plurality of fingers) may be provided so that a MOS transistor is not long and narrow if a gate width (W) is wide. In this case, a plurality of diffusion layers are arranged in parallel to the gate electrodes. In this arrangement, however, the diffusion layers are arranged in parallel as a group in correspondence with the plurality of gate electrodes. This is different from the arrangement of this embodiment in which the diffusion layer is divided and arranged in the perpendicular direction.

According to the above-described embodiment, even if the driver transistor falls outside the element substrate when it is arranged in a region as in the conventional example, it is possible to arrange the heater and driver transistor in the region by dividing the driver transistor into portions, forming the portions stepwise, and connecting them. This makes it possible to effectively use the area of the element substrate having a shape such as a parallelogram, thereby reducing the substrate area. Furthermore, since it is possible to arrange a heater in the vicinity of the end portion of the substrate, it is possible to shorten the distance between heaters, that is, the distance between ink orifices with respect to another neighboring element substrate. With this arrangement, upon forming a printhead using a plurality of element substrates, it can be expected to improve the image quality in the connection portion of the element substrates.

Although a driver transistor can be obliquely arranged in accordance with the shape of the element substrate, it is also possible to obtain an effect capable of ensuring a wide gate width (W) which largely influences the capability of a transistor by arranging the transistor stepwise as in this embodiment. If the transistor is obliquely arranged, the implantation angle of impurities changes during a semiconductor manufacturing process, and thus the transistor characteristics undesirably change. In this embodiment, however, it is possible to ensure the same transistor characteristics as in the conventional example since the angle of the transistor is the same as in the conventional example.

Second Embodiment

Figure 6A:
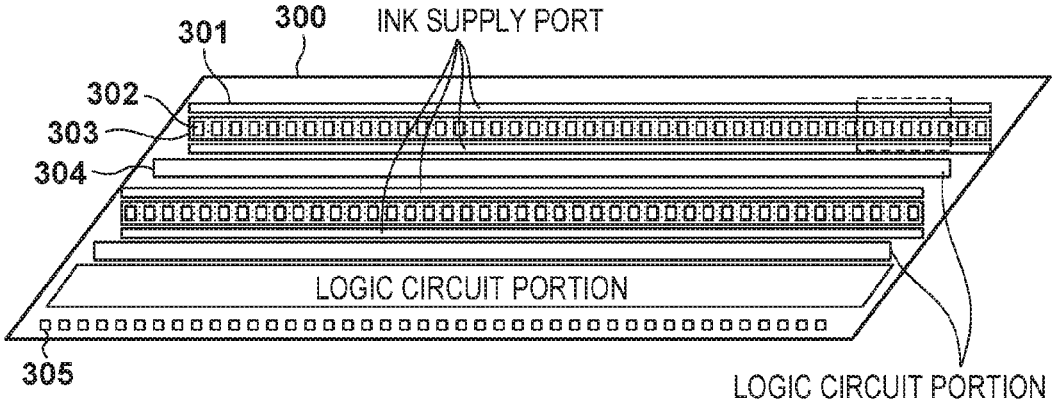
FIGS. 6A, 6B, and 6C are views for explaining an element substrate according to the second embodiment.
Figure 6B:
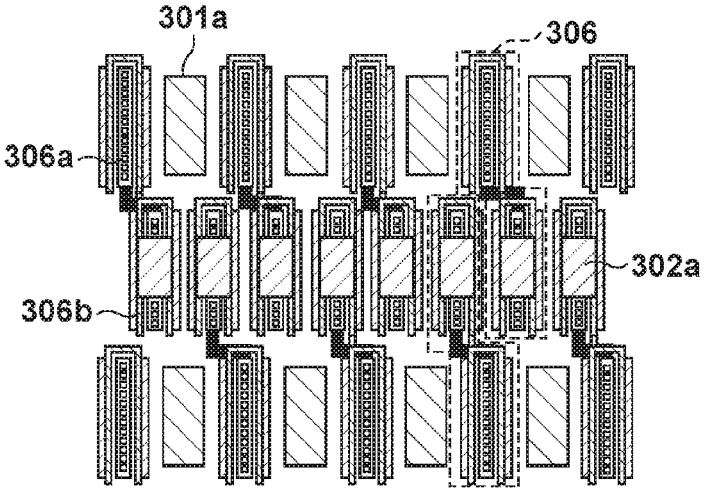
Figure 6C:
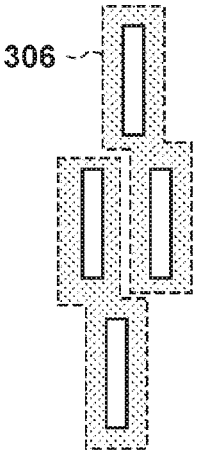

FIGS. 6A to 6C are views for explaining an element substrate according to the second embodiment.

In FIG. 6A, reference numeral 300 denotes an element substrate; reference numeral 301, ink supply ports; reference numeral 302, heater arrays; reference numeral 303, driver transistor arrays; reference numeral 304, logic circuit portions; and reference numeral 305, connection terminals (electrodes). Note that each ink supply port 301 shown in FIG. 6A is individually arranged in correspondence with each heater. The element substrate 300 shown in FIG. 6A has a shape of a parallelogram but may have another shape such as a trapezoid or rectangle. Furthermore, a position at which each electrode 305 is arranged may be on either the short or long side.

FIG. 6B is an enlarged view showing the heater array 302 and the driver transistor array 303 which are surrounded by broken lines in FIG. 6A. FIG. 6B shows individual ink supply ports 301*a* each corresponding to one heater, individual heaters 302*a*, and individual driver transistors 306. Each driver transistor 306 connected to one heater 302*a* is divided into two portions 306*a* and 306*b*, and arranged and connected in the lower layer of the heater 302*a* and a region between the individual ink supply ports 301*a*. Note that FIG. 6C schematically shows the shape of each driver transistor 306 connected to one heater.

Figure 7:
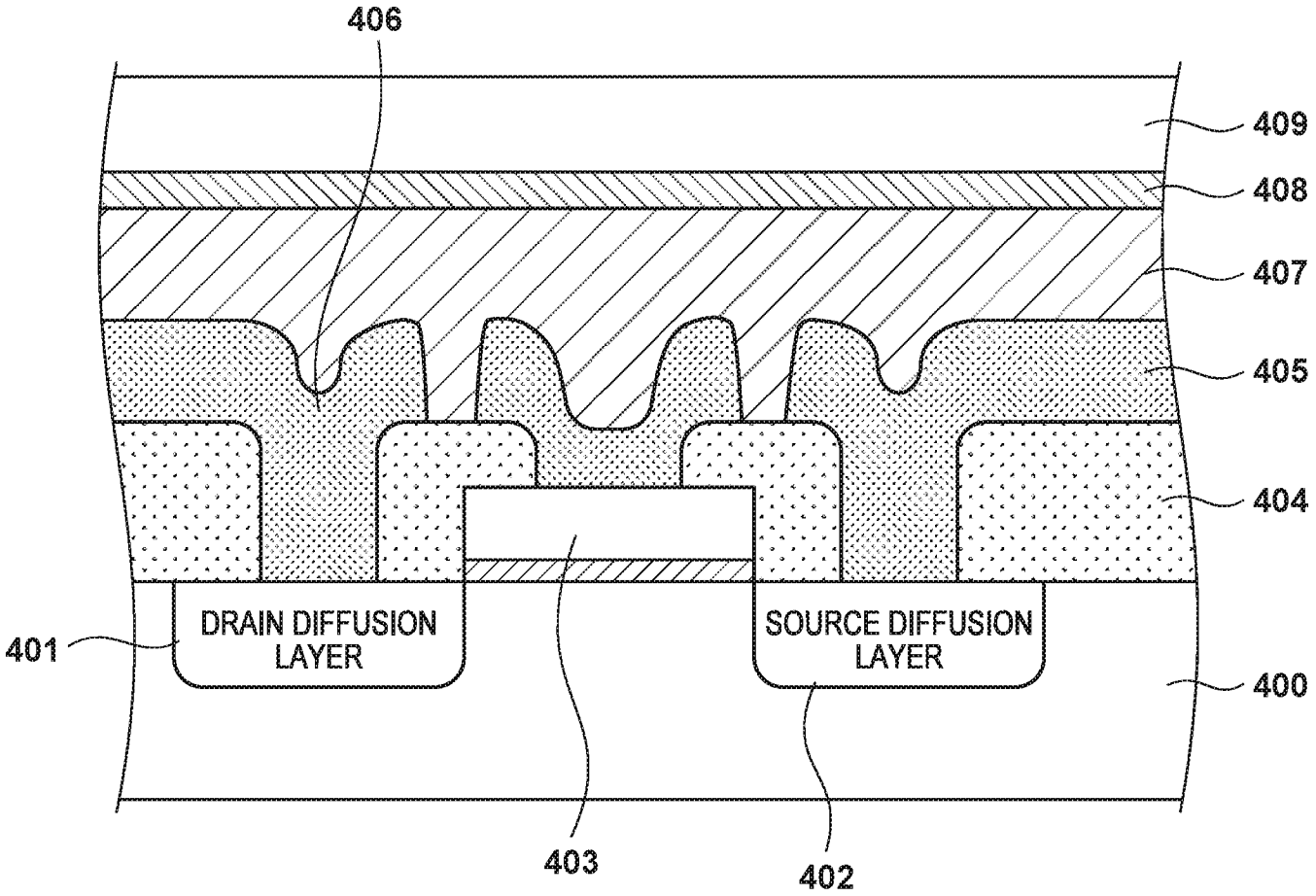
FIG. 7 is a sectional view of a MOSFET.

FIG. 7 is a sectional view showing the structure (of a portion) in a case where a MOS transistor is arranged in the lower layer of the heater 302*a*.

In FIG. 7, reference numeral 400 denotes a silicon substrate; reference numeral 401, the diffusion layer of a drain electrode; reference numeral 402, the diffusion layer of a source electrode; reference numeral 403, a gate electrode; reference numeral 404, an insulation film; reference numeral 405, a conductive film; reference numeral 406, a contact hole; reference numeral 407, an insulation film; reference numeral 408, a heater layer; and reference numeral 409, a protection film. Note that in this example, the conductive film 405 has a structure of one layer. However, the conductive film 405 may have a plurality of layers such as two or three layers. In addition, in this example, the heater layer 408 is individually formed. However, the heater layer 408 may be formed in contact with the conductive film 405, and only a portion serving as a heater may be etched.

Upon arranging a printhead using such an element substrate, an ink orifice and an ink chamber communicating with it are formed on the heater 302*a*, thereby forming an ink channel for supplying ink with the individual ink supply port corresponding to one heater. The distance of the ink channel is designed in accordance with the relationship between an ink refilling time after ink discharge and a next discharge timing. If the distance is long, the ink filling time becomes long, and ink cannot be filled before the next discharge timing. On the other hand, as shown in FIG. 6B, if the individual ink supply ports 301*a* are arranged on two sides of the heater 302*a*, the distance between the individual ink supply ports (in a direction perpendicular to the direction of the heater array 302) is limited. Therefore, upon forming the driver transistor 306 in the lower layer of the heater 302*a*, it is impossible to form a driver transistor of the same size as in the conventional example.

This embodiment employs an arrangement in which the driver transistor 306 is divided and arranged. That is, the portion 306*a* of the divided driver transistor is arranged in a beam portion between the individual ink supply ports 301*a* (in a direction parallel to the heater array direction), and connected to the other portion 306*b* of the divided driver transistor, which has been arranged in the lower layer of the heater 302*a*. This arrangement can reduce a region of the driver transistor conventionally arranged between the heater array 302 and the logic circuit portion 304, thereby significantly reducing the substrate area.

Note that since the distance between the individual ink supply ports 301*a* is short, even if, as shown in FIG. 6B, the driver transistor 306 is divided into two portions and the two portions are respectively formed in the lower portion of the heater 302*a* and the region between the individual ink supply ports 301*a*, it may be impossible to ensure the same transistor size as in the conventional example. In this case, the driver transistor can be arranged between the ink supply port and the logic circuit portion.

FIGS. 8A to 8E are views for explaining an element substrate according to a modification of the second embodiment.

Figure 8A:
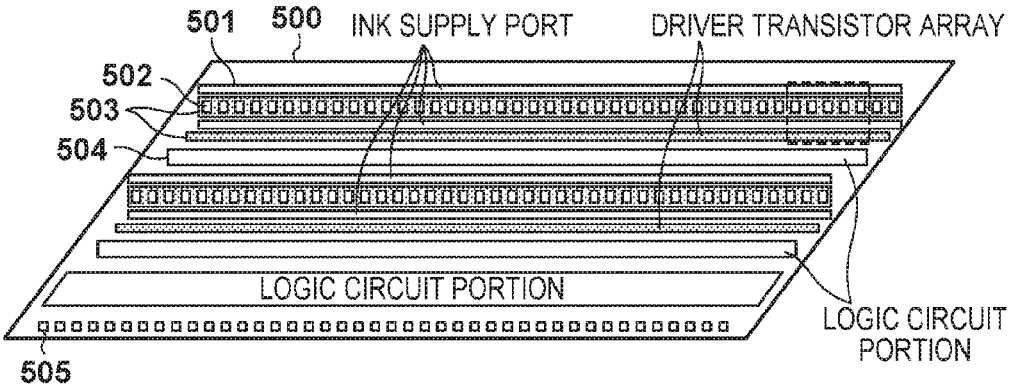
FIGS. 8A, 8B, 8C, 8D, and 8E are views for explaining an element substrate according to a modification of the second embodiment.

In FIG. 8A, reference numeral 500 denotes an element substrate; reference numeral 501, ink supply ports; reference numeral 502, heater arrays; reference numeral 503, driver transistor arrays; reference numeral 504, logic circuit portions; and reference numeral 505, connection terminals (electrodes). Note that in this arrangement, each ink supply port is individually arranged in correspondence with each heater. The element substrate 500 shown in FIG. 8A has a shape of a parallelogram but may have another shape such as a trapezoid or a rectangle. A position at which each electrode is arranged may be on either the short or long side.

Figure 8B:
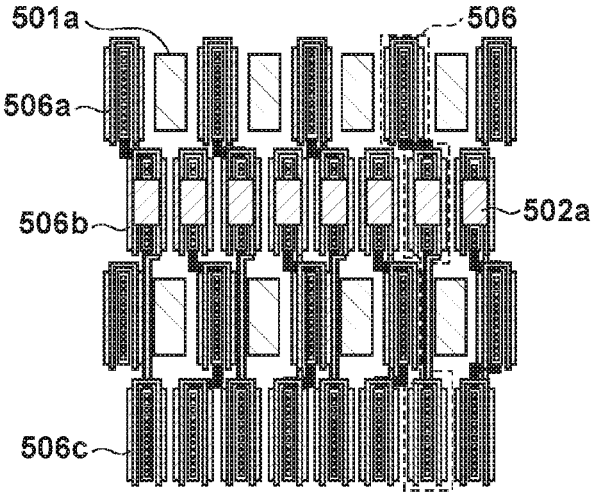

FIG. 8B is an enlarged view showing the heater array and the driver transistor array of a portion surrounded by broken lines in FIG. 8A. FIG. 8B shows individual ink supply ports 501*a* each corresponding to one heater, individual heaters 502*a*, and individual driver transistors 506. Each driver transistor 506 connected to one heater 502*a* is divided into three portions 506*a* to 506*c*. The three portions are arranged and connected in the lower region portion 506*b* of the heater 502*a*, the region portion 506*a* between the individual ink supply ports 501*a*, and the region portion 506*c* between the individual ink supply port 501*a* and the logic circuit portion 504.

Figure 8C:
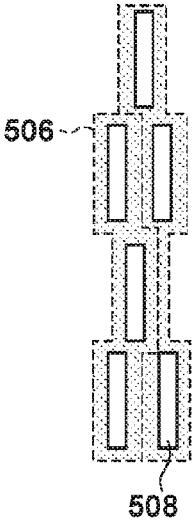

In this arrangement, the substrate area is wider than that in the arrangement shown in FIG. 6A. However, the portion 506*c* of the driver transistor formed between the individual ink supply port 501*a* and the logic circuit portion 504 is not sandwiched between the individual ink supply ports 501*a*. Therefore, it is possible to ensure a space in the upper layer, in which a wide power supply wiring is arranged. Note that FIG. 8C schematically shows the shape of each driver transistor 506 connected to one heater.

Figure 8D:
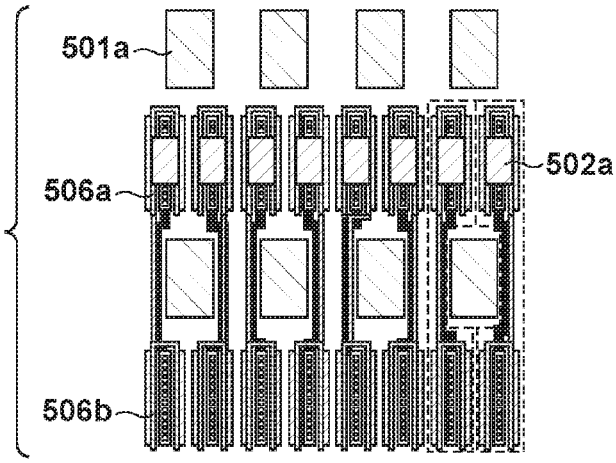
Figure 8E:
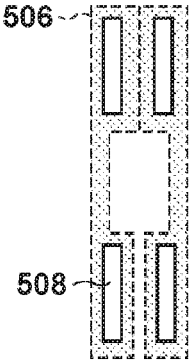

FIG. 8D is a view showing the division arrangement of the driver transistor 506 in a case where a portion of the driver transistor cannot be arranged between the individual ink supply ports 501*a*. In this case, the driver transistor 506 is divided into two portions, the portion 506*a* is arranged in the lower layer of the individual heater 502*a* and the other portion 506*b* is arranged between the individual ink supply port 501*a* and the logic circuit portion. Note that FIG. 8E schematically shows the shape of each driver transistor 506 connected to one heater. In this arrangement, since no driver transistor is arranged between the individual ink supply ports in the heater array direction, it is possible to have a sufficient distance between the individual ink supply port and the driver transistor, thereby ensuring the reliability. Note that in FIGS. 8C and 8E, reference numeral 508 denotes the diffusion layers of drain electrodes.

Therefore, according to the above-described embodiment, it is possible to arrange a portion of the driver transistor in the lower layer of the heater, thereby reducing the area of the element substrate. Furthermore, since the shapes of the respective driver transistors are not identical, if such shape is formed by a single driver transistor, the characteristics unwantedly change. However, it is possible to equalize the characteristics of the respective transistors by employing a wiring connection arrangement by dividing each driver transistor as in this embodiment.

Third Embodiment

Figure 9A:
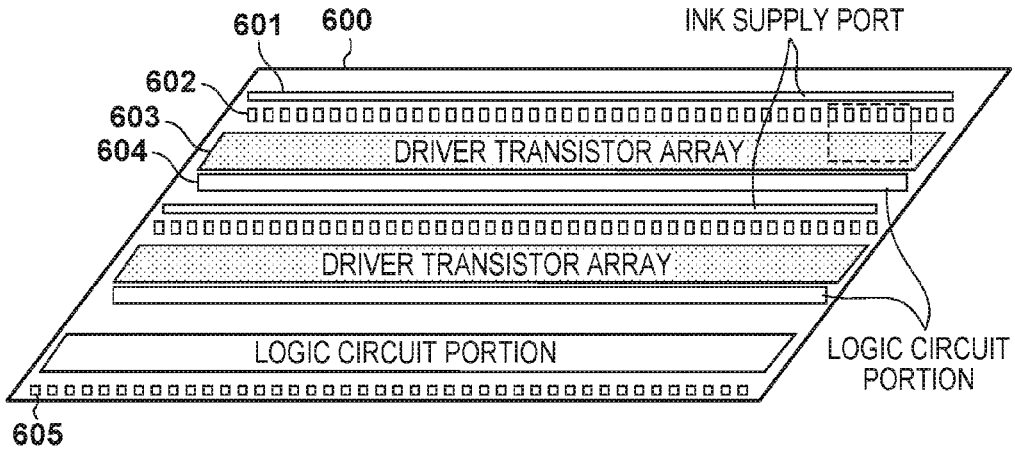
FIGS. 9A, 9B, and 9C are views for explaining an element substrate according to the third embodiment.
Figure 9B:
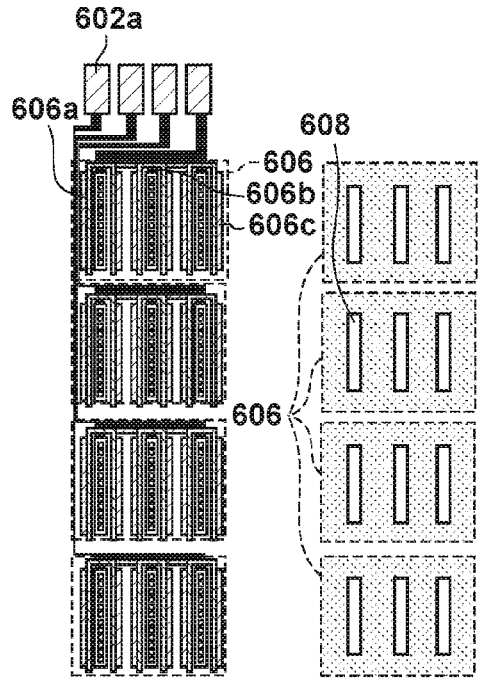
Figure 9C:
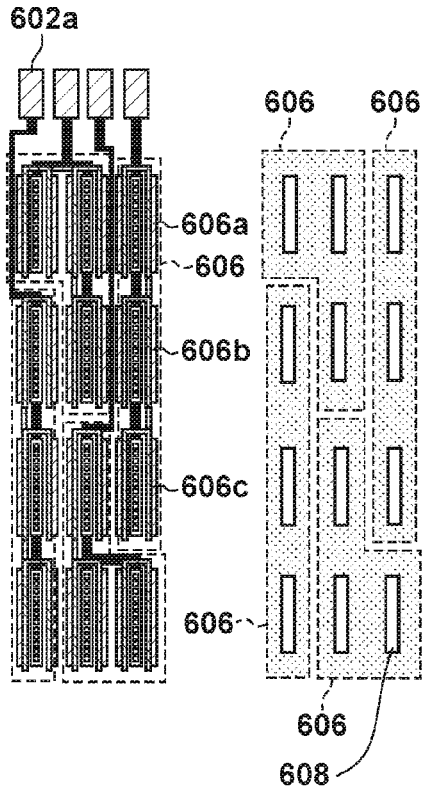

FIGS. 9A to 9C are views for explaining an element substrate according to the third embodiment.

In FIG. 9A, reference numeral 600 denotes an element substrate; reference numeral 601, ink supply ports; reference numeral 602, heater arrays; reference numeral 603, driver transistor arrays; reference numeral 604, logic circuit portions; and reference numeral 605, connection terminals (electrodes). Note that each ink supply port may be an ink supply port common to one array or an individual ink supply port arranged in correspondence with each heater. The ink supply ports may be formed on one side or two sides of the heater array. The element substrate 600 shown in FIG. 9A has a shape of a parallelogram but may have another shape such as a trapezoid or rectangle. Furthermore, a position at which each electrode is arranged may be on either the short or long side.

FIG. 9B is an enlarged view showing the heater array and the driver transistor array of a region surrounded by broken lines in FIG. 9A. FIG. 9B shows individual heaters 602*a*, and individual driver transistors 606 corresponding to the heaters 602*a*. Each driver transistor 606 connected to one heater 602*a* and surrounded by broken lines is divided into three portions 606*a* to 606*c*, formed, and connected. Note that the arrangement of the four individual driver transistors 606 respectively connected to the four heaters is schematically shown on the right side of FIG. 9B.

A high voltage is applied to the driver transistor 606 for driving the heater 602*a*. The driver transistor 606 needs to sufficiently ensure the gate length and the distance between each diffusion layer and the gate electrode so as to normally operate even when a high voltage is applied. To ensure resistance to the applied voltage, the minimum transistor size is limited.

On the other hand, an image printed by a printing apparatus is required to have a high resolution. To meet this requirement, it is required to shorten the heater pitch of the element substrate included in a printhead. However, the heater pitch may become shorter than the minimum pitch at which the driver transistors are arranged, thereby disabling arrangement of the heaters and the driver transistors in one-to-one correspondence.

FIG. 9B exemplifies a case in which the heater pitch is smaller than the driver transistor pitch. In this example, only three driver transistors can be arranged with respect to four heaters. To deal with this, in this embodiment, the driver transistor corresponding to the heater has a divisional arrangement. That is, as shown in FIG. 9B, each driver transistor is divided into three portions, the divided portions 606*a* to 606*c* are arranged in a direction (heater array direction) in which the four heaters are arranged, and the four driver transistors are arranged in a direction perpendicular to (intersecting) the heater array direction. The three divided portions are connected to correspond to one heater.

As described above, if only N (N<M) driver transistors can be arranged at the length of an array of M heaters in the heater array direction, each driver transistor divided by a unit of the least common multiple (LCM) of M and N (LCM=12 for M=4 and N=3) is formed. The divided driver transistors are arranged in the heater array direction and a direction perpendicular to (intersecting) it. By arranging the divided driver transistors, the width (W) of the driver transistor corresponding to each heater arranged in a limited region is maximized, thereby improving the layout efficiency.

In the layout arrangement shown in FIG. 9B, however, it is necessary to extend and connect wirings from the heaters to the three driver transistors arranged away from the heaters, and thus three wirings need to be arranged between the neighboring driver transistors. On the other hand, the driver transistors are neighboring to each other at a short distance, and thus thin wirings are used to arrange three wirings, resulting in high wiring resistances.

To solve this problem, in this embodiment, the divisional arrangement of the driver transistor shown in FIG. 9C is used. In the arrangement shown in FIG. 9B, the four driver transistors have the same shape. In the arrangement shown in FIG. 9C, one driver transistor is divided into three portions but the driver transistors have different shapes. That is, a combination of an arrangement in which the three driver transistors are connected in the direction perpendicular to the heater array direction and an arrangement in which groups of three driver transistors connected in a hook shape are connected is employed. The driver transistors have a two-divisional arrangement in the direction perpendicular to the heater array direction, and thus it is necessary to connect one wiring to the driver transistor arranged away from the heater, thereby making it possible to use a relatively thick wiring. Note that in FIGS. 9B and 9C, reference numeral 608 denotes drain electrodes.

Therefore, according to the above-described embodiment, even if only N (N<M) driver transistors can be arranged at the length of an array of M heaters in the heater array direction, each driver transistor can be efficiently divided and arranged on the element substrate.

Note that the element substrate having a shape of a parallelogram is used in this embodiment. However, as described above, the shape is not limited to a parallelogram, and the element substrate may have a trapezoidal shape or uneven shape.

Figure 10A:
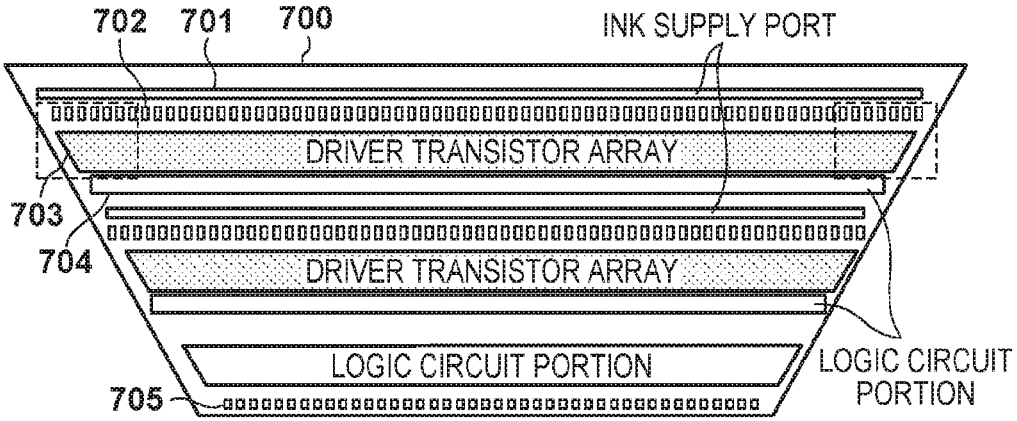
FIGS. 10A and 10B are views for explaining the layout of an element substrate having a trapezoidal shape according to a modification of the third embodiment.
Figure 10B:
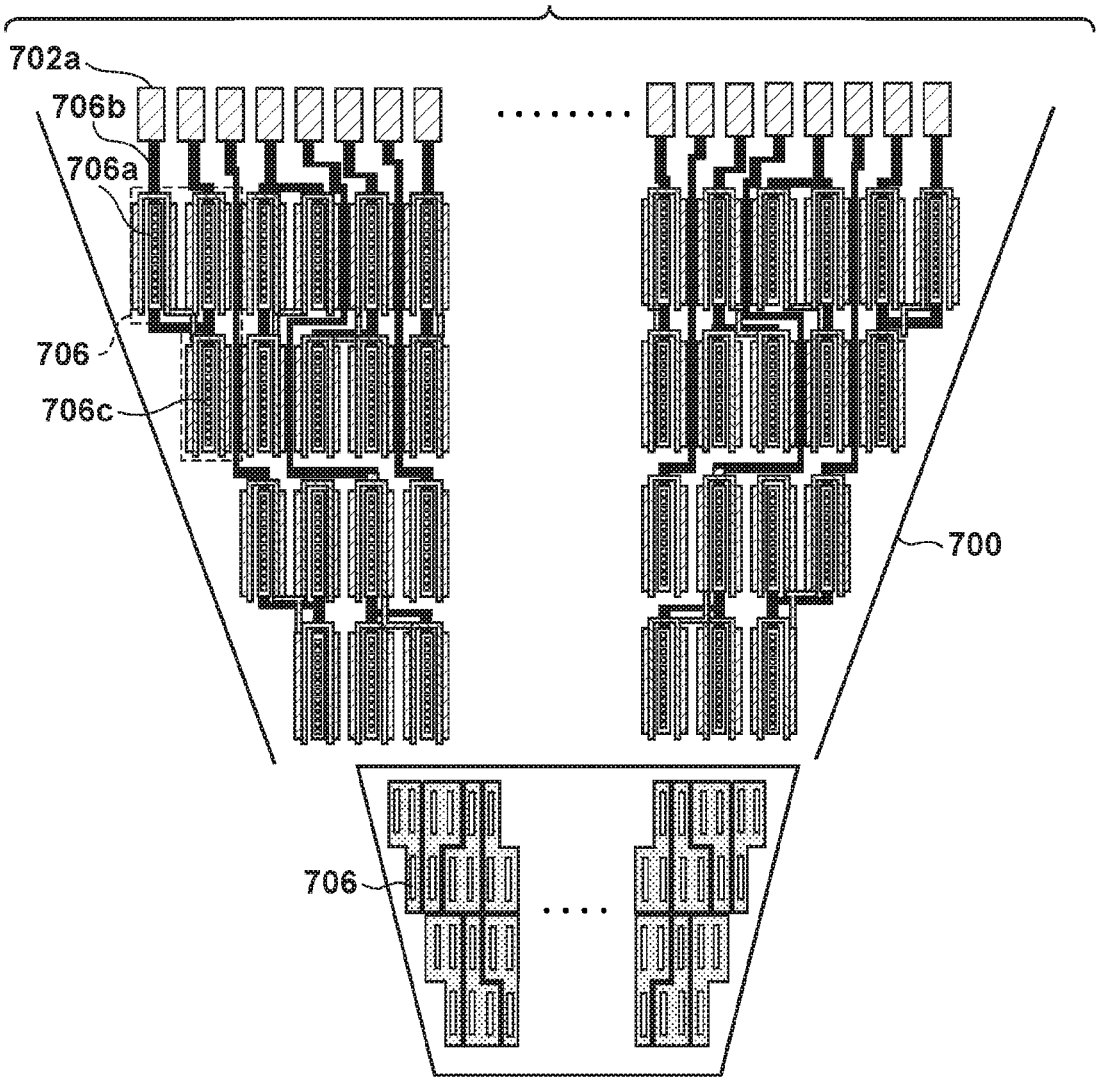
Figure 11A:
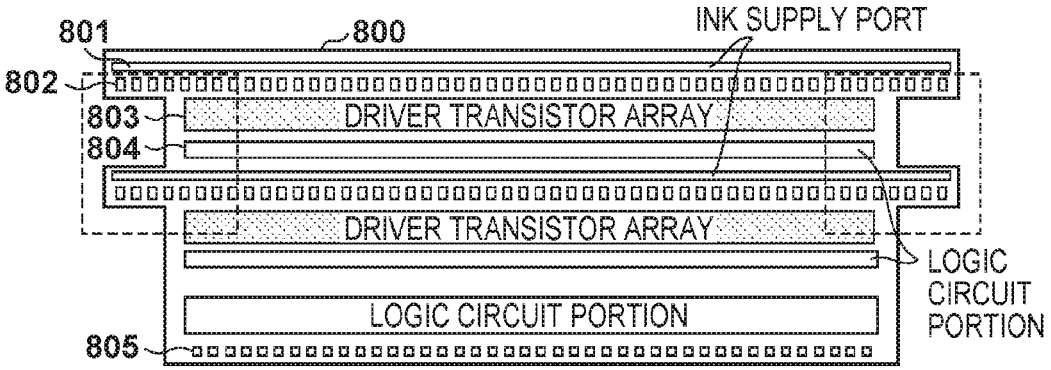
FIGS. 11A and 11B are views for explaining the layout of an element substrate having an uneven shape according to another modification of the third embodiment.
Figure 11B:
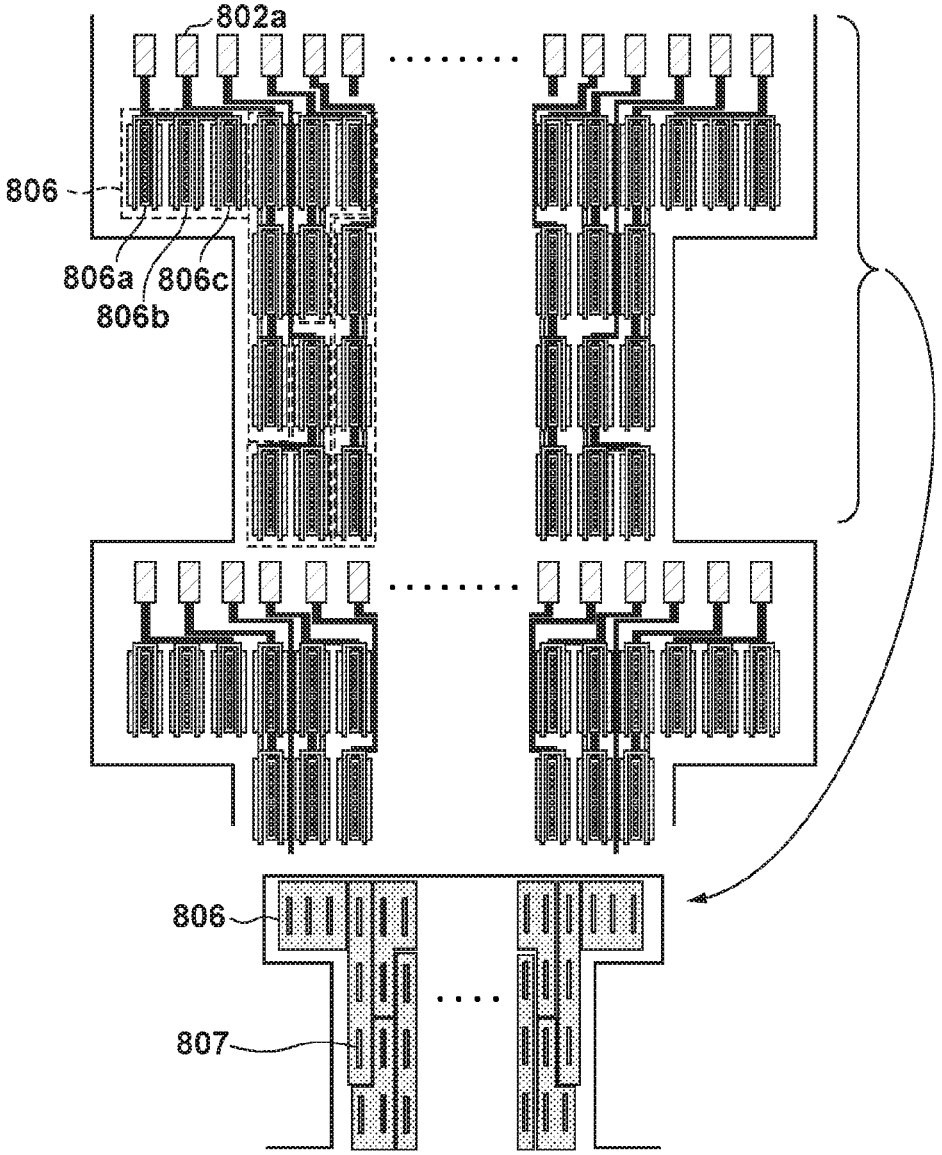

FIGS. 10A and 10B are views showing the layout of an element substrate having a trapezoidal shape. FIGS. 11A and 11B are views showing the layout of an element substrate having an uneven shape. In these examples, an ink supply port may be an ink supply port common to one array or an individual ink supply port arranged in correspondence with each heater. The ink supply ports may be formed on one side or two sides of the heater array.

Note that in FIG. 10A, reference numeral 700 denotes an element substrate; reference numeral 701, ink supply ports; reference numeral 702, heater arrays; reference numeral 703, driver transistor arrays; reference numeral 704, logic circuit portions; and reference numeral 705, connection terminals (electrodes). FIG. 10B is an enlarged view showing the heater array and the driver transistor array of a region surrounded by broken lines in FIG. 10A. FIG. 10B shows individual heaters 702*a* and individual driver transistors 706 corresponding to the heaters 702*a*. Each driver transistor 706 connected to one heater 702*a* and surrounded by broken lines is divided into three portions 706*a* to 706*c*, formed, and connected. The arrangement of the driver transistors 706 connected to the respective heaters is schematically shown on the lower side of FIG. 10B.

In FIG. 11A, reference numeral 800 denotes an element substrate; reference numeral 801, ink supply ports; reference numeral 802, heater arrays; reference numeral 803, driver transistor arrays; reference numeral 804, logic circuit portions; and reference numeral 805, connection terminals (electrodes). FIG. 11B is an enlarged view showing the heater array and the driver transistor array of a region surrounded by broken lines in FIG. 11A. FIG. 11B shows individual heaters 802*a* and individual driver transistors 806 corresponding to the heaters 802*a*. Each driver transistor 806 connected to one heater 802*a* and surrounded by broken lines is divided into three portions 806*a* to 806*c*, formed, and connected. Note that the arrangement of the driver transistors 806 connected to the respective heaters is schematically shown on the lower side of FIG. 11B. Reference numeral 807 denotes the diffusion layers of drain electrodes.

As described above, driver transistors can be divided and efficiently arranged in two end portions of the element substrate having a trapezoidal shape or uneven shape. That is, if N (N<M) driver transistors are arranged at the length of the array of M heaters in the heater array direction, the driver transistors are divided by the least common multiple of M and N and arranged. This can equalize and maximize the widths of the driver transistors corresponding to the respective heaters. Note that in a case where a plurality of element substrates are arranged to form a full-line printhead, the plurality of element substrates are arranged in a direction in which a plurality of heaters are arrayed. Particularly, in a case where a shape of the element substrate is either a parallelogram or trapezoidal, a direction in which a plurality of element substrates are arranged may slightly be slanted to a direction in which a plurality of heaters are arrayed so that a distance between heaters in a connecting portion of neighboring element substrates becomes short.

In the above-described three embodiments, the element substrate is integrated in the printhead for discharging ink to perform printing, and the printhead is mounted on the printing apparatus. However, the element substrate need not always be used for the printhead or printing apparatus. For example, the element substrate may be integrated in a liquid discharge head for discharging a drug or liquid. In this case, the print element is more generally called an electrothermal transducer (heater), and the print element array is an electrothermal transducer array (heater array).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-001073, filed Jan. 6, 2015, which is hereby incorporated by reference herein in its entirety.

What is claimed is:

1. An element substrate comprising:

a plurality of electrothermal transducers arranged in a predetermined direction; and a plurality of driver transistors respectively corresponding to the plurality of electrothermal transducers and configured to drive the plurality of electrothermal transducers, wherein each of the plurality of driver transistors is divided into a plurality of portions by dividing a diffusion layer of a drain electrode of the transistor into a plurality of diffusion layer portions of the drain electrode in a direction intersecting the predetermined direction, the plurality of divided portions are connected and the plurality of divided diffusion layer portions are connected to form one driver transistor, and connected to the corresponding electrothermal transducer, and wherein the element substrate has a side which is diagonally extended with respect to the predetermined direction, and the plurality of divided portions are arranged stepwise along the side.

2. The element substrate according to claim 1, wherein the plurality of divided portions are arranged stepwise.

3. The element substrate according to claim 1, wherein any one of the plurality of divided portions is provided in a lower layer of the corresponding electrothermal transducer.

4. The element substrate according to claim 1, further comprising a plurality of supply ports provided along the predetermined direction in which the plurality of electrothermal transducers are arranged and configured to supply liquid, wherein any one of the plurality of divided portions is provided between the plurality of supply ports.

5. The element substrate according to claim 1, wherein if N driver transistors are arranged at a length in the predetermined direction in which M electrothermal transducers are arranged where N is smaller than M, the N driver transistors are divided by a least common multiple of M and N, N divided portions are arranged in the predetermined direction, M divided portions are arranged in a direction perpendicular to the predetermined direction, and the M divided portions are connected to form one driver transistor.

6. The element substrate according to claim 5, wherein the N divided portions are connected in the predetermined direction to form the one driver transistor.

7. The element substrate according to claim 5, wherein the one driver transistor is formed by either connecting the N divided portions in the direction perpendicular to the predetermined direction, or connecting part of the N divided portions in the predetermined direction and connecting the remaining portions of the N divided portions in the direction perpendicular to the predetermined direction.

8. The element substrate according to claim 1, wherein the shape of the element substrate is one of a parallelogram, a trapezoid, and an uneven shape.

9. The element substrate according to claim 1, wherein the divided diffusion layer portions of the drain electrode are arranged in the direction intersecting the predetermined direction.

10. The element substrate according to claim 1, wherein each of the driver transistors is formed by connecting the plurality of divided portions based on a shape of the element substrate.

11. A liquid discharge head including a plurality of element substrates, each comprising:

a plurality of electrothermal transducers arranged in a predetermined direction; and a plurality of driver transistors respectively corresponding to the plurality of electrothermal transducers and configured to drive the plurality of electrothermal transducers, wherein each of the plurality of driver transistors is divided into a plurality of portions by dividing a diffusion layer of a drain electrode of the transistor into a plurality of diffusion layer portions of the drain electrode in a direction intersecting the predetermined direction, the plurality of divided portions are connected and the plurality of divided diffusion layer portions are connected to form one driver transistor, and connected to the corresponding electrothermal transducer, the plurality of element substrates are arranged to form a full-line printhead having a printing width corresponding to a width of a print medium, and wherein the element substrate has a side which is diagonally extended with respect to the predetermined direction, and the plurality of divided portions are arranged stepwise along the side.

* * * * *